United States Patent [19]

Richard et al.

[11] Patent Number: 5,033,240

[45] Date of Patent: Jul. 23, 1991

[54] METHOD AND APPARATUS TO ENSHROUD LARGE VERTICAL STRUCTURES

[76] Inventors: Louis J. Richard, 2237 N. Parker, Dexter, Mich. 48130; Kenneth M. Richard, 6400 Conway, Chelsea, Mich. 48118

[21] Appl. No.: 531,845

[22] Filed: Jun. 1, 1990

[51] Int. Cl.[5] ..... E04B 1/12

[52] U.S. Cl. ..... 52/63; 52/747; 212/200; 212/204

[58] Field of Search ..... 52/71, 5, 747, 41, 29, 52/27, 63, DIG. 13; 212/199, 200, 204

[56] References Cited

U.S. PATENT DOCUMENTS 1,759,628 5/1930 Pellegrino .
3,945,106 3/1976 Mayr et al. .
4,522,010 6/1985 Schrader .
4,787,173 11/1988 Lewis .
4,794,974 1/1989 Melino .

FOREIGN PATENT DOCUMENTS 5231546 3/1977 Japan .

*Primary Examiner*—David A. Scherbel
*Assistant Examiner*—Creighton Smith
*Attorney, Agent, or Firm*—James M. Deiman

[57] ABSTRACT

Apparatus to temporarily enclose multi-story structures such as municipal water towers during sandblasting and painting to thereby contain the debris and overspray from the environment. A plurality of booms extending in an array outwardly from the top of the structure are temporarily attached to the structure. Hoisting and guide cables extend downwardly from the ends of the booms out beyond the outermost periphery of the structure. A plurality of fabric or plastic panels are supported on a framework in turn attached to guides on the guide cables and the guides are attached to the hoisting cables. The guide cables are anchored to ground. The hoisting cables are connected to a common hoisting engine. The entire assembly of panels can be raised in unison about the structure for daily activities and then lowered at night or quickly lowered in the event of high winds.

19 Claims, 10 Drawing Sheets

METHOD AND APPARATUS TO ENSHROUD LARGE VERTICAL STRUCTURES

BACKGROUND OF THE INVENTION

The field of the invention pertains to the field of temporarily covering or enclosing objects and structures of large size during treatment or processing and, in particular, to enclosing such objects in a manner that contains and retains materials that otherwise would be released to the environment. Only recently a significant demand for means to cover large objects and structures has arisen because of new rules to prevent the release of old paint, sand blasting materials, new paint overspray and asbestos to the environment.

Means to quickly cover or uncover a large object have been available for many years in a variety of forms such as that disclosed in U.S. Pat. No. 1,759,628 wherein an automobile may be quickly covered and uncovered. More recently U.S. Pat. No. 4,787,173 discloses a means to quickly cover and uncover fruit trees with minimal damage to the trees.

U.S. Pat. No. 4,794,974 discloses a dust curtain for interior protection from dust generated in a portion of an interior room. U.S. Pat. No. 3,945,106 discloses a means of constructing a natural draft cooling tower by raising a ring on a central tube, the ring having a cable assembly suspended therefrom. The cable assembly supports a larger ring to provide a fixed upper diameter for the tower. The cable configuration provides the proper geometric shape for the cooling tower and a support upon which are attached panels of plastic, metal or asbestos cloth.

the above approaches to enshrouding an object or structure do not suggest means to enshroud structure as large as municipal water towers and petroleum storage tanks. Under new rules being mandated for environmental protection, enshrouding is being required for the sand blasting and painting of such large structures to prevent contamination of the environment with dust, paint chips and paint spray.

SUMMARY OF THE INVENTION

The invention comprises apparatus and method for enshrouding or enclosing multistory structures or buildings such as municipal water towers and large petroleum storage tanks that may be 50 to 250 feet, in height. Recent environmental regulations require that sandblasting debris and paint over-spray be contained and prevented from release to the environment. In practicing the invention a plurality of booms are temporarily attached to the top of the structure so as to extend out beyond the periphery of the structure. Extending downwardly from the boom ends are guide cables and hoisting cables to guide and raise a frame work having a plurality of fabric or plastic panels attached thereto. The guide cables are fastened to the ground and the hoisting cables are fastened to sleeves on the cables, the sleeves serving as the guides. Horizontal telescopic tubes serve to support the panels and extend between the guides and guide cables.

The ends of the booms are equipped with sheaves or pulleys over which the hoisting cables pass. The hoisting cables either extend downwardly from the sheaves directly to one or more hoisting engines or, where the structure is equipped with a central riser, or shaft from ground to roof, the hoisting cables extend generally horizontally to a central multiple sheave assembly and then downwardly to a common down haul cable. The common downhaul cable in turn is connected to a hoisting engine near the base of the structure. When not in use the panels are collapsed and folded at the base of the structure. The entire assembly of panels can be raised in unison about the structure for daily activities and then lowered at night or quickly lowered in the event of high winds.

The booms are fitted with a main or central support and wind braces or stabilizers having both telescoping and rotational adjustments in the fittings that attach to the booms and to the structure. The particular adjustability permits the boom assemblies including the central supports and wind braces to accommodate the compound curvature tops of contemporary single leg water towers and traditional multiple leg waters towers. The boom assemblies are equipped with pads or feet that are temporarily welded to the steel plate tops of the towers. After the repainting of the tower is otherwise completed the pads are cut free from the tower and the weld locations spot painted. In an alternative embodiment special upright flanges or brackets are permanently welded to the top or roof so that the boom assemblies can be easily pinned or bolted in place when the structure is to be sand blasted and repainted.

DESCRIPTION OF THE DRAWINGS

FIG. 18-A is a detail of the boom; and

DESCRIPTION OF THE PREFERRED EMBODIMENTS

Figure 1:
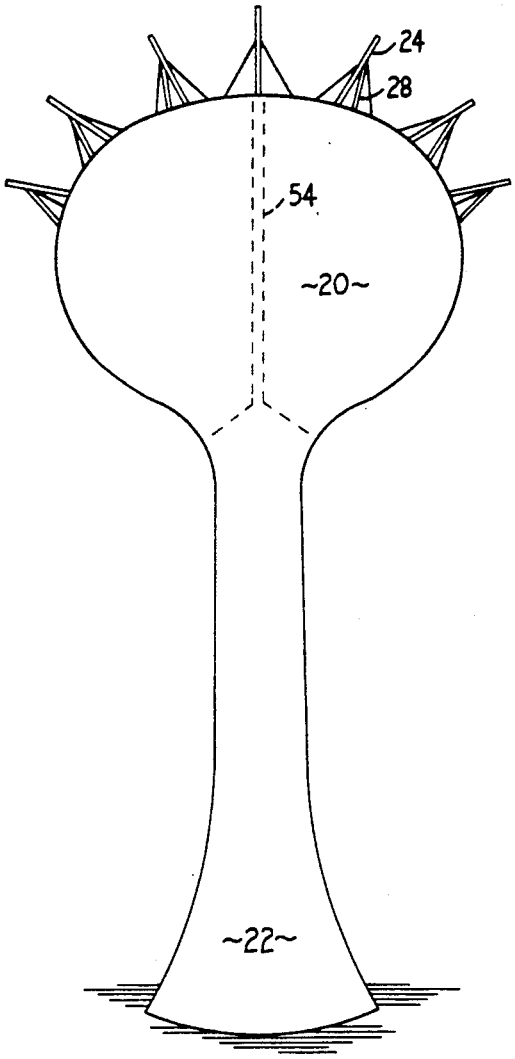
FIG. 1 illustrates a single column water tower equipped with temporary booms.

Illustrated in FIG. 1 is a contemporary water tower 20 commonly in use in the United States. Typically such water towers are 150 to 200 feet in height, constructed of steel plates with welded joints and supported on a flared base 22. The towers are painted to reduce corrosion and improve appearance. The initial painting and periodic repainting requires an initial sand blasting to clean the outer surface prior to spray painting. Considerable debris is released to the air and surrounding ground by the sand blasting and spray painting. The following method and apparatus vertically encloses structures such as a water tower to thereby capture and contain the sandblasting debris and the overspraying of paint.

Figure 2:
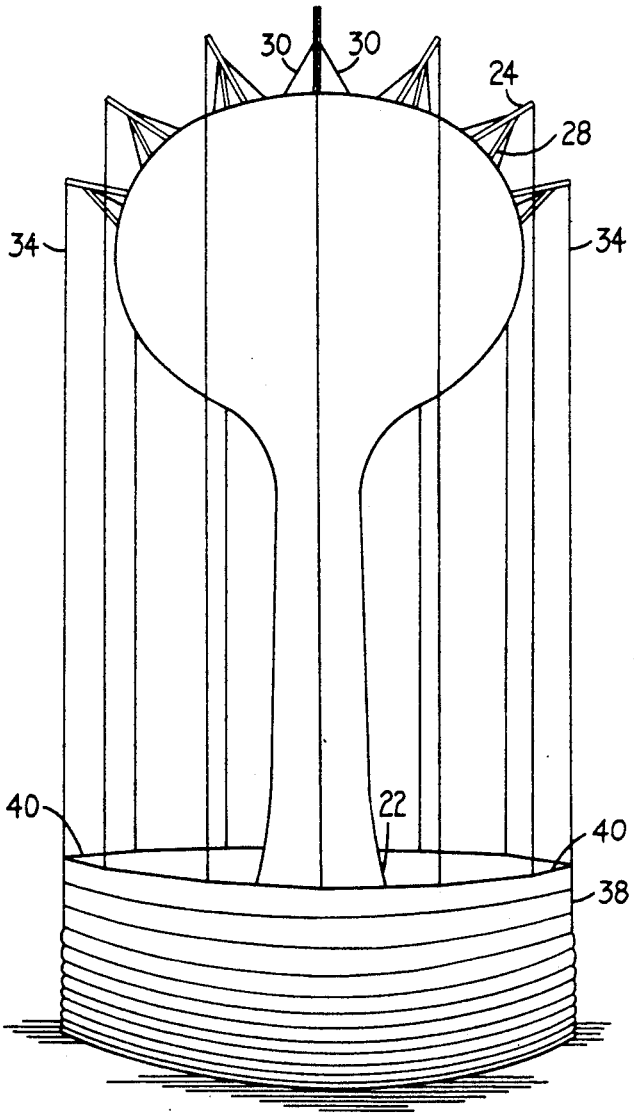
FIG. 2 illustrates the water tower of FIG. 1 with hoisting cables and folded shroud.
Figure 3:
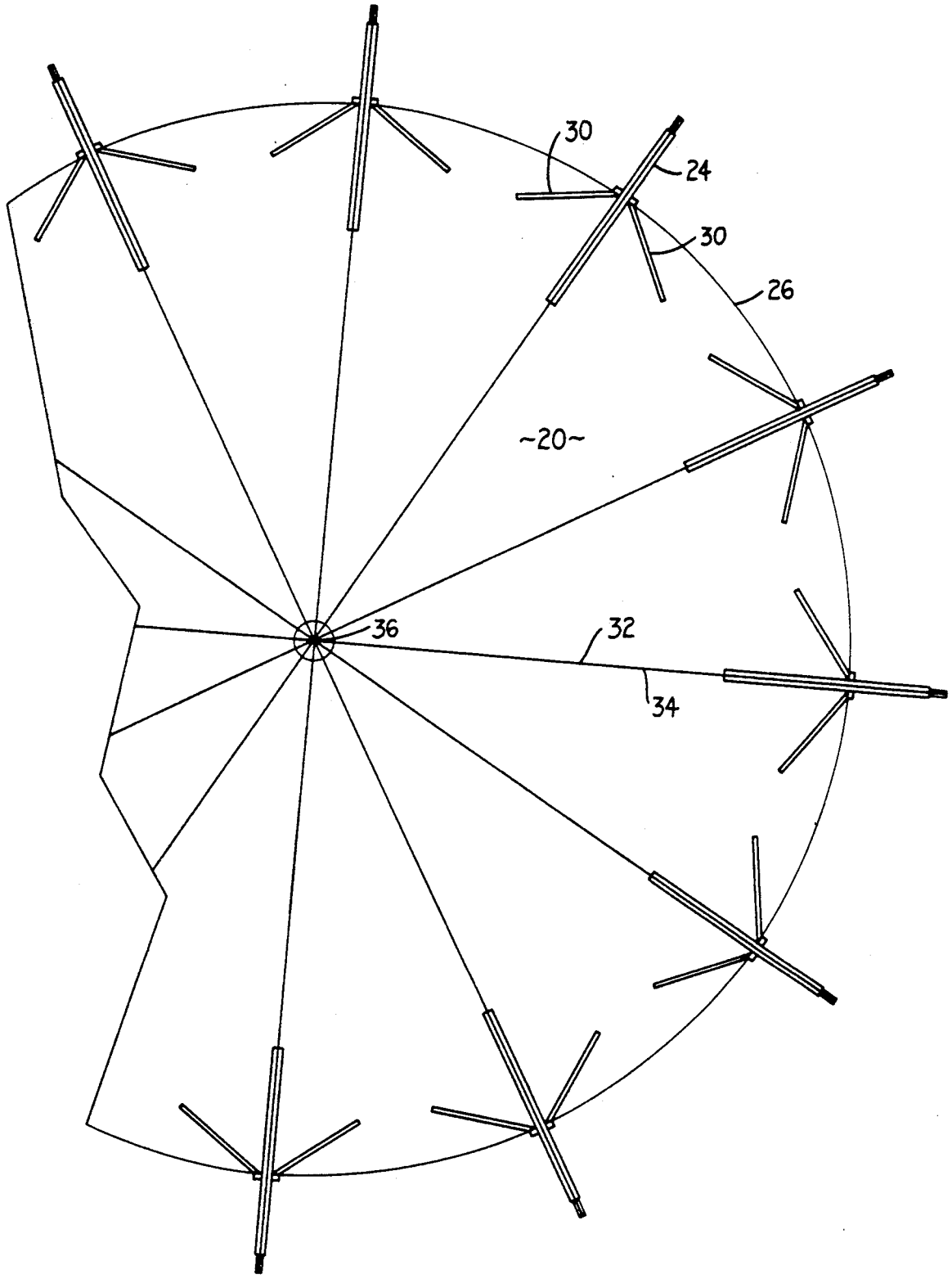
FIG. 3 schematically illustrates in broken away plan view the top of the water tower of FIG. 1 equipped with temporary booms and hoisting cables.

In practicing the invention a plurality of booms 24 are temporarily attached about the upper portion of the tower 20, each boom extending out beyond the periphery 26 of the tower 20 as shown in the top view, FIG. 3. Each boom is supported on a central leg 28 as shown in FIGS. 1 and 2 and stabilized by a pair of wind braces or stabilizers 30, all of which are fastened to the top of the tower 20. Tieback cables 32 and hoisting cables 34 extend from the booms 24 to the central top 36 of the tower 20.

Figure 4:
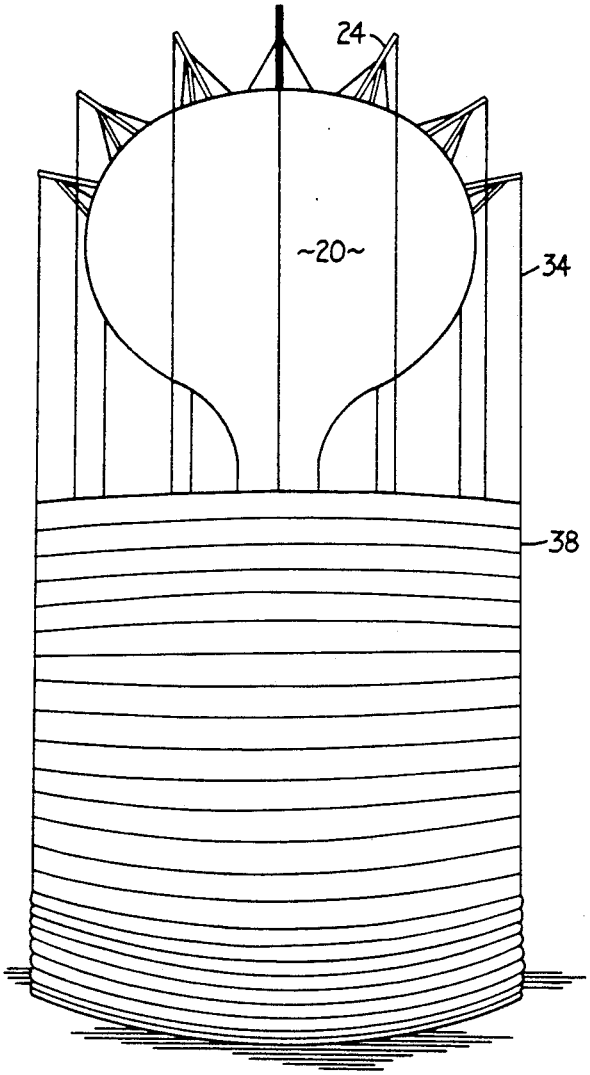
FIG. 4 illustrates the shroud partially raised about the water tower of FIG. 1.
Figure 5:
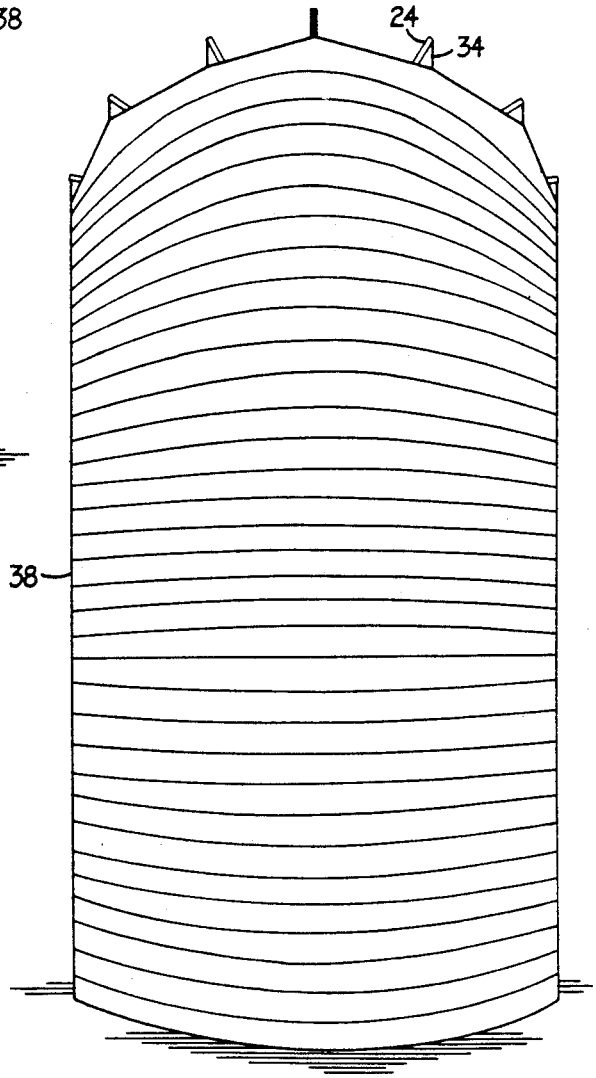
FIG. 5 illustrates the shroud fully raised about the water tower of FIG. 1.

FIGS. 2, 4, and 5 illustrate the collapsible enclosure or shroud 38 in various positions about the tower 20. In FIG. 2 the shroud 38 is shown substantially folded or collapsed about the base 22 of the tower. A plurality of hoisting cables 34 are attached to the shroud 38 adjacent the top 40 of the shroud and extend vertically to the booms 24, engaging the booms at the boom outer ends.

The shroud 38 is raised by simultaneously raising the plurality of hoisting cables 34. As the hoisting cables 34 raise the shroud 38 the shroud unfolds at the base 22 of the tower 20 as shown in FIG. 4. The shroud 38 is shown fully raised about the tower in FIG. 5. In his manner the shroud 38 which comprises multiple panels of cloth or plastic may be raised and lowered on a daily basis as work on the tower progresses or the shroud can be quickly lowered in the event the wind velocity about the tower becomes too large to safely work on the tower within the raised shroud.

Figure 6:
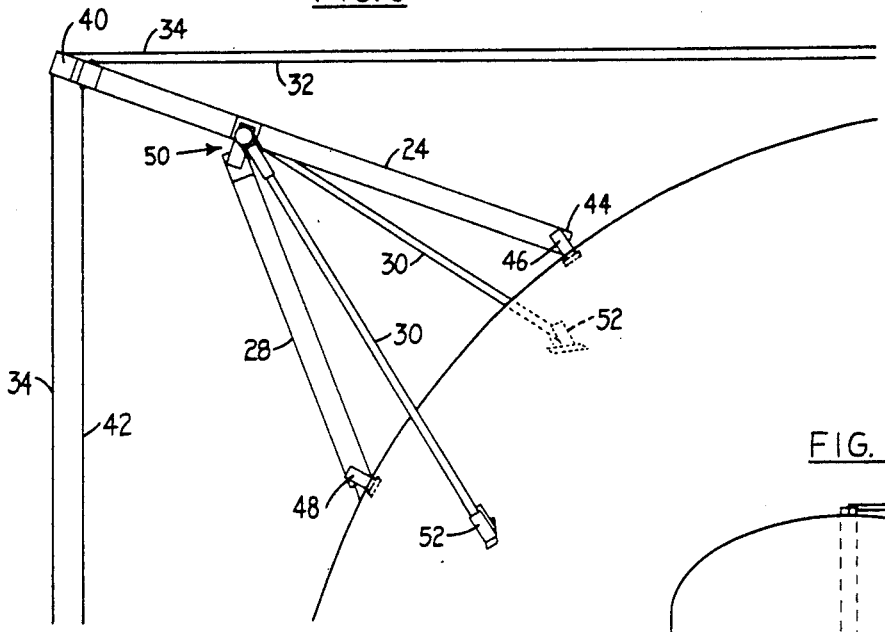
FIG. 6 is a perspective view of a boom assembly mounted on a water tower.
Figure 7:
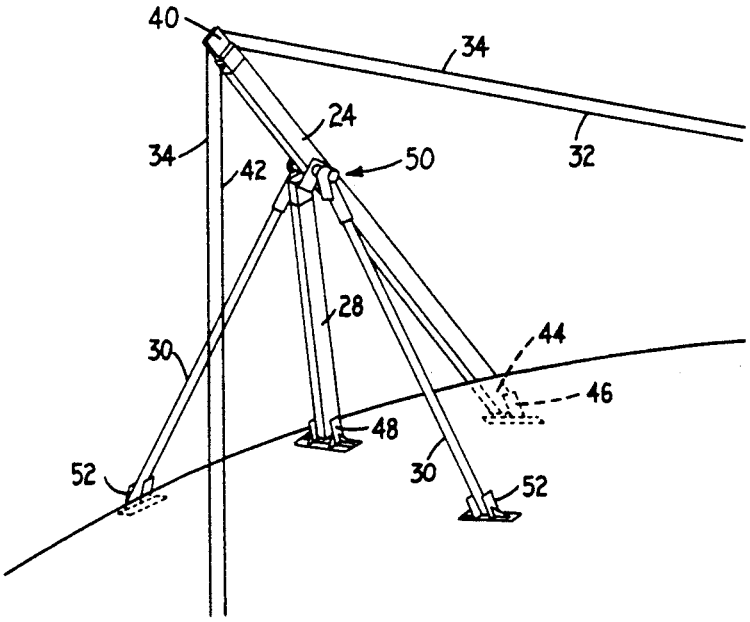
FIG. 7 is a second perspective view of a boom assembly mounted on a water tower.

Illustrated in perspective in FIGS. 6 and 7 is a typical boom 24 shown with a hoisting cable 34 passing over the outboard end 40 of the boom. Also attached to the boom 24 at the outboard end is a tie back cable 32 and a vertical guide cable 42. The inboard end 44 of the boom 24 is attached to the ellipsoidal steel plate surface of the tower 20 by a metal foot 46. As best shown in FIG. 6 the outboard end 40 of the boom 24 extends out beyond the maximum periphery of the tower 20 with sufficient clearance for the skyhook platform of the sandblast and spray paint crews. The central leg 28 supports the boom 24 downward thrust and is attached by a foot 48 to the surface of the tower 20. A pair of side wind braces 30 are connected to the boom 24 by the same attachment generally denoted by 50 as the central leg 28. Each of the wind braces 30 is similarly attached to the tower surface by feet 52.

Figure 10:
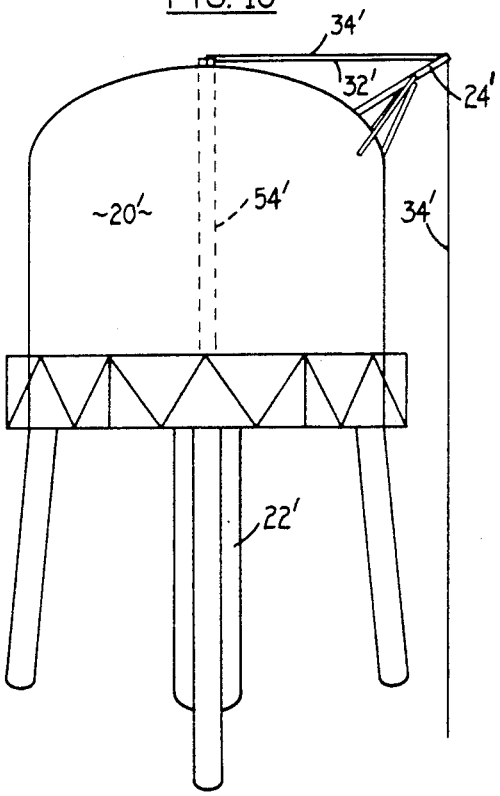
FIG. 10 illustrates a boom mounted on a multiple leg water tower.
Figure 8:
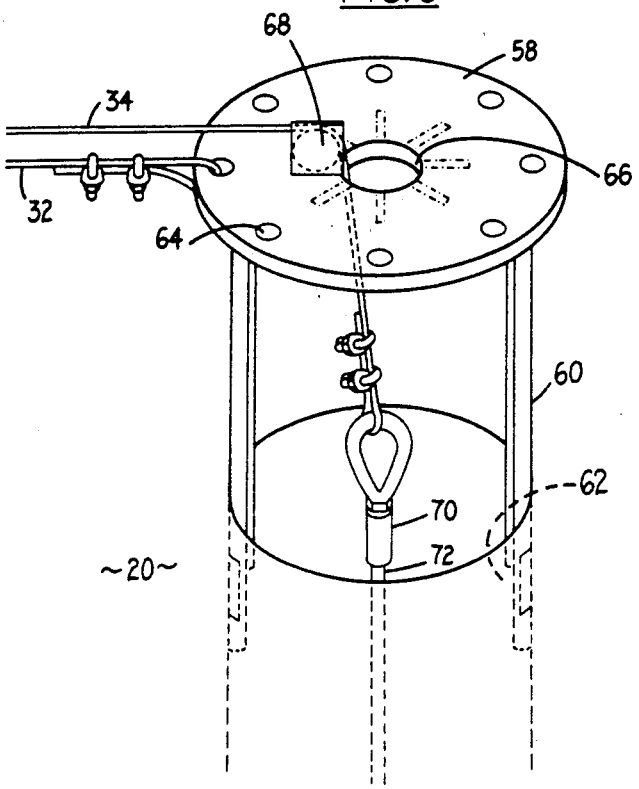
FIG. 8 is a detail of the hoisting pulley assembly at the top center of a water tower.
Figure 9:
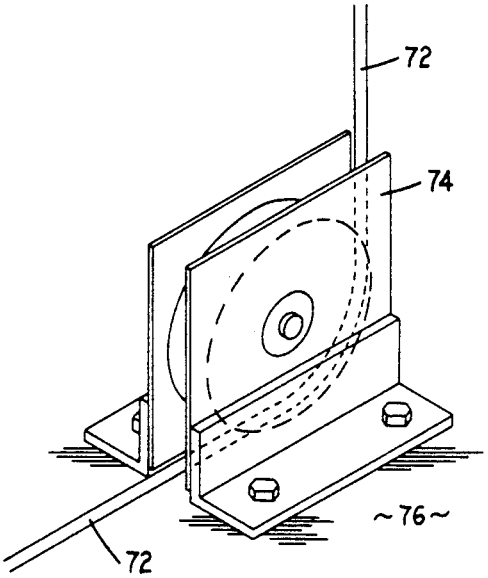
FIG. 9 is a detail of the pulley assembly at the base of a water tower.

The contemporary ellipsoidal water tower 20 of FIG. 1 and the more traditional multileg water tower 20′ of FIG. 10 typically are equipped with a central riser 54′ that extends to a covered opening at the center top 36 (FIG. 3) of the tower. The central riser 54 provides access to the top of the tower 20 without the need for an external ladder or lifting means. As shown in FIG. 8 the opening 56 to the central riser 54 is used to support a circular plate 58 attached by legs 60 to the opening 56 sides 62. The circular plate 58 includes a plurality of holes 64 to engage a plurality of tie back cables 32 one of which is shown in FIG. 8.

Mounted about a central hole 66 in the circular plate 58 are a plurality of sheave assemblies 68 one of which is shown and the others of which indicated by dot-dash outline. The hoisting cables 34 pass over the sheave assemblies 68 and down through the hole 66. The plurality of hoisting cables 34 are joined by fittings at 70 to a single down cable 72. The single down cable 72 extends to the base 22 of the tower 20 where the down cable 72 passes under a sheave assembly 74 in turn anchored to the floor 76 as shown or otherwise lashed in place. The sheave assembly 74 is inside the central leg of the tower 20. The down cable 72 then extends horizontally to a hoisting engine (not shown).

Figure 11:
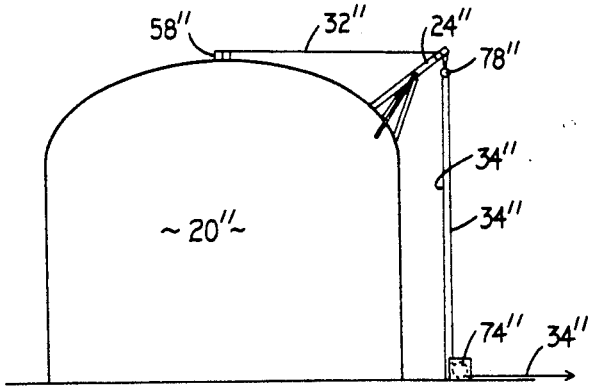
FIG. 11 illustrates a boom mounted on a large ground supported petroleum storage tank.

FIGS. 10 and 11 illustrate alternate forms of water towers and liquid storage tanks to which the method and apparatus for enshrouding a large vertical structure may be applied. FIG. 10 illustrates a multileg tower 20′ having a central riser 54′ through the tank and a central column 22′ therebelow. As illustrated by the single boom 24′, tie back 32′ and hoisting cable 34′ the boom assemblies disclosed above can be applied to this traditional form of water tower 20′ in the same manner as with the contemporary tower.

FIG. 11 illustrates a large ground based storage tank 20″ not equipped with a central riser. The booms 24″ and tie backs 32″ are mounted as disclosed above, however, the circular plate 58″ is merely welded to the top of the tank 20″. Each hoisting cable 34″ passes around a secondary block 78″ and down to a pulley assembly 74″ attached firmly to the ground. The hoisting cables 34″ are then led to one or more hoisting engines (not shown). With very large diameter tanks only a portion of the periphery may be enshrouded and the tank need not be simultaneously equipped with booms 24″ all around.

Figure 12:
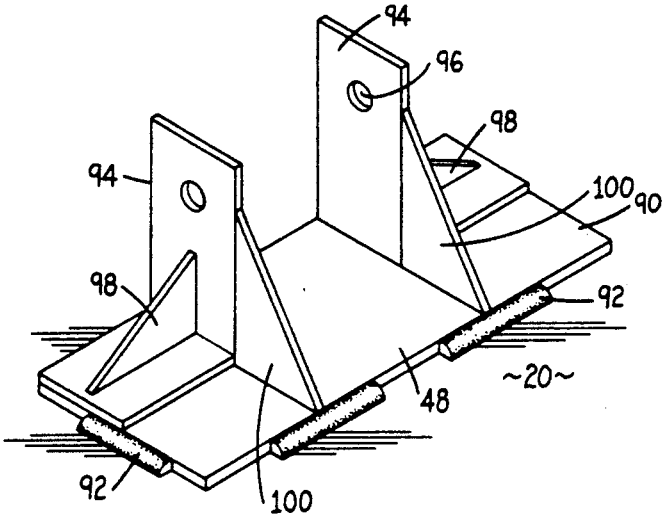
FIG. 12 is a center foot pad for the boom assembly.
Figure 13:
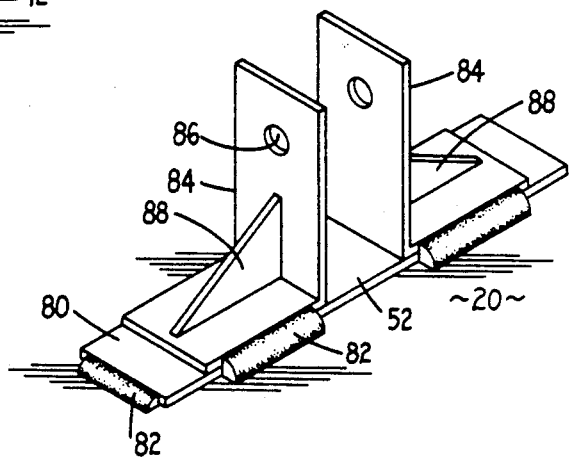
FIG. 13 is a peripheral foot pad for the boom assembly.

FIGS. 12 through 19 illustrate detailed features of the apparatus for enshroudment to be particularly effective. FIGS. 12 and 13 illustrate attachment feet or pads (46, 48 and 52 in FIGS. 6 and 7) for the boom assemblies. The pad 52 of FIG. 13 comprises a horizontal plate 80 that is temporarily welded 82 to the surface of the tower 20. Permanently welded to the plate 80 are a pair of brackets 84 perforated at 86 for bolt or pin attachment to the wind braces 30. Gussets 88 are permanently welded inside the brackets 84 for added stiffness. The pad of FIG. 13 may also be used to attach the inboard end 44 of the boom 24 to the tower surface.

The pad 48 of FIG. 12 comprises a wider horizontal plate 90 also temporarily welded 92 to the tower surface. Permanently welded to the plate 90 are a pair of brackets 94 perforated at 96 for bolt or pin attachment to the central leg 28. Gussets 98 are permanently welded inside the brackets 94 for added stiffness. Because of the major thrust load on the central leg 28, the horizontal plate 90 is extended in width to accommodate a second pair of gussets 100 permanently welded to the brackets 94 and plate 90. The pad of FIG. 12 may also be used to attache the inboard end 44 of the boom 24 to the tower.

Figure 14:
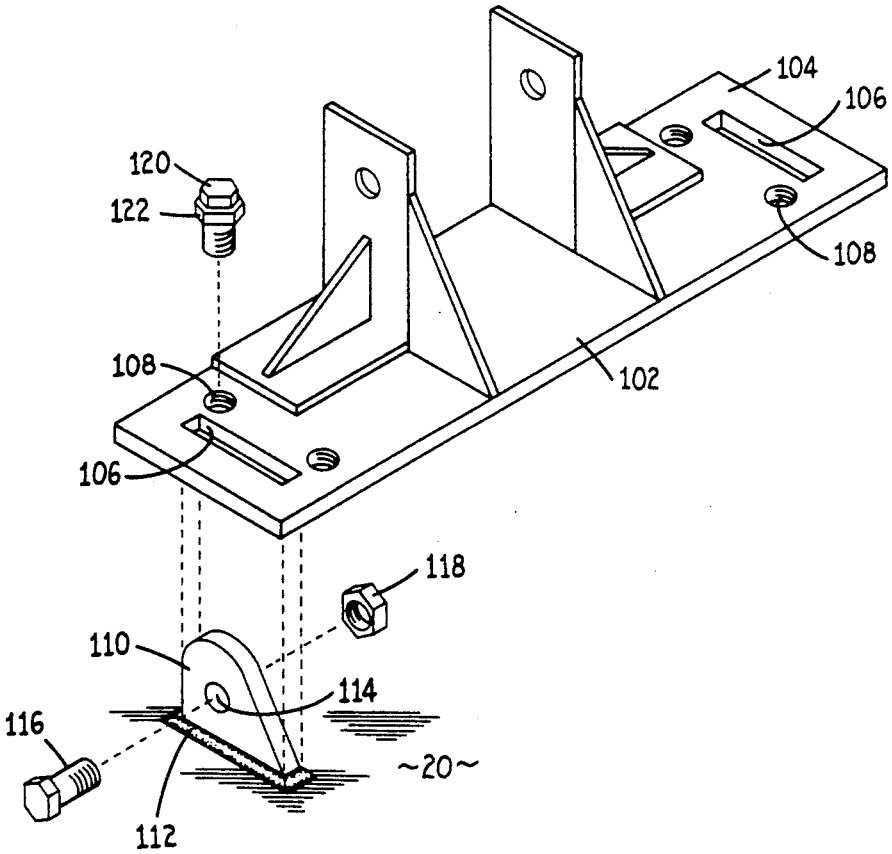
FIG. 14 is an alternate form of the foot pad of FIG. 12.

The pads 48 and 52 (FIG. 8) are welded to the tower surface prior to mounting of the boom assemblies on the tower and removed after completion of and blasting and spray painting by cutting the welds 82 and 92. The weld points are then spot painted. As an alternative to the welding and removal FIG. 14 illustrates a pad 102 similar to the pad 48 in FIG. 12. Pad 102 horizontal plate 104, however, is larger and equipped with slots 106 at the ends thereof and a pair of threaded holes 108 adjacent each slot 106. The pair of slots 106 are adapted to engage a pair of brackets 110 permanently welded 112 to the tower surface. The brackets 110 are perforated 114 for a bolt 116 and nut 118 or pin inserted after the plate 104 is engaged on the brackets 110. The bolt 116 and nut 118 prevent the removal of the pad 102 from the tower surface. To provide necessary tightness and rigidity the bolts 120 are threaded through holes 108 and into tight engagement with the tower surface. The lock nuts 122 then are threaded down against the plate 104 to prevent inadvertent loosening. The brackets 110 remain a permanent part of the water tower 20 and are painted with the tower. With the alternate pad 102 of FIG. 14 the boom assemblies may be attached or removed from the tower without welding. Since sandblasting and spray painting of water towers is a periodic maintenance activity, the alternate pads 102 represent a substantial saving of time to install and remove the boom assemblies.

Figure 15:
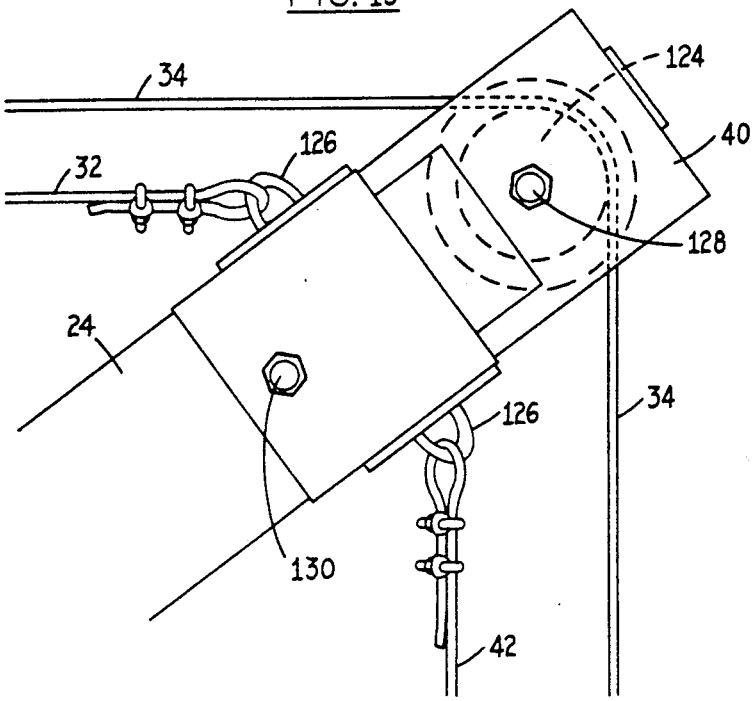
FIG. 15 is a side view detail of the boom tip.

The boom 24 outboard end 40 is depicted in FIG. 15. The hoisting cable 34 passes over a pulley 124 at the end of the boom. Eyes 126 just inside the hoisting cable 34 are attached to the boom 24 end to provide attachment locations for the tie back cable 32 and the guide cable 42. In the preferred embodiment the boom 24 is extruded structural aluminum I-section. The boom end 40 is constructed of steel plates to retain the pulley 124 with a bolt axle 128 and is attached to the boom by a bolt at 130. Aluminum is used for the boom 24 and central leg 28 to eliminate a substantial portion of the boom assembly weight.

Figure 16:
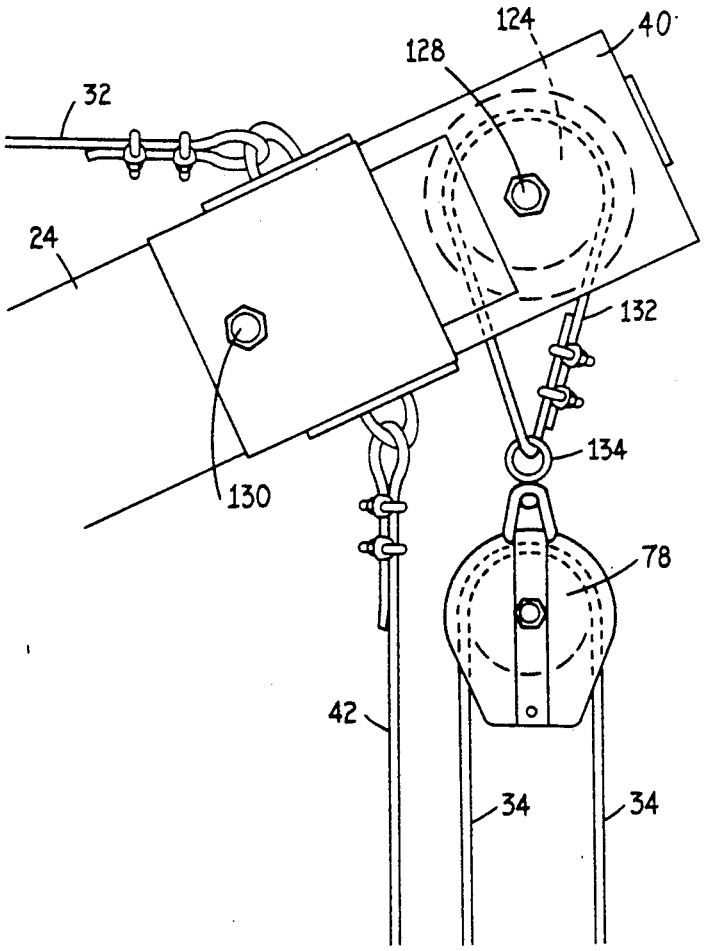
FIG. 16 is a side view detail alternate configuration of the boom tip.

FIG. 16 illustrates the boom end 40 modified for use with the tank illustrated in FIG. 11. In particular a separate block 78 supports the hoisting cable thereabout adjacent the guide cable 42. The block 78 in turn is supported by a short length of cable 132 looped through the block ring 134 and about pulley 124. This assembly prevents chafing of the hoisting cable 34 if the hoisting cable is wrapped directly around the pulley 124 and the boom 24 is positioned at a relatively steep angle to horizontal.

Figure 17:
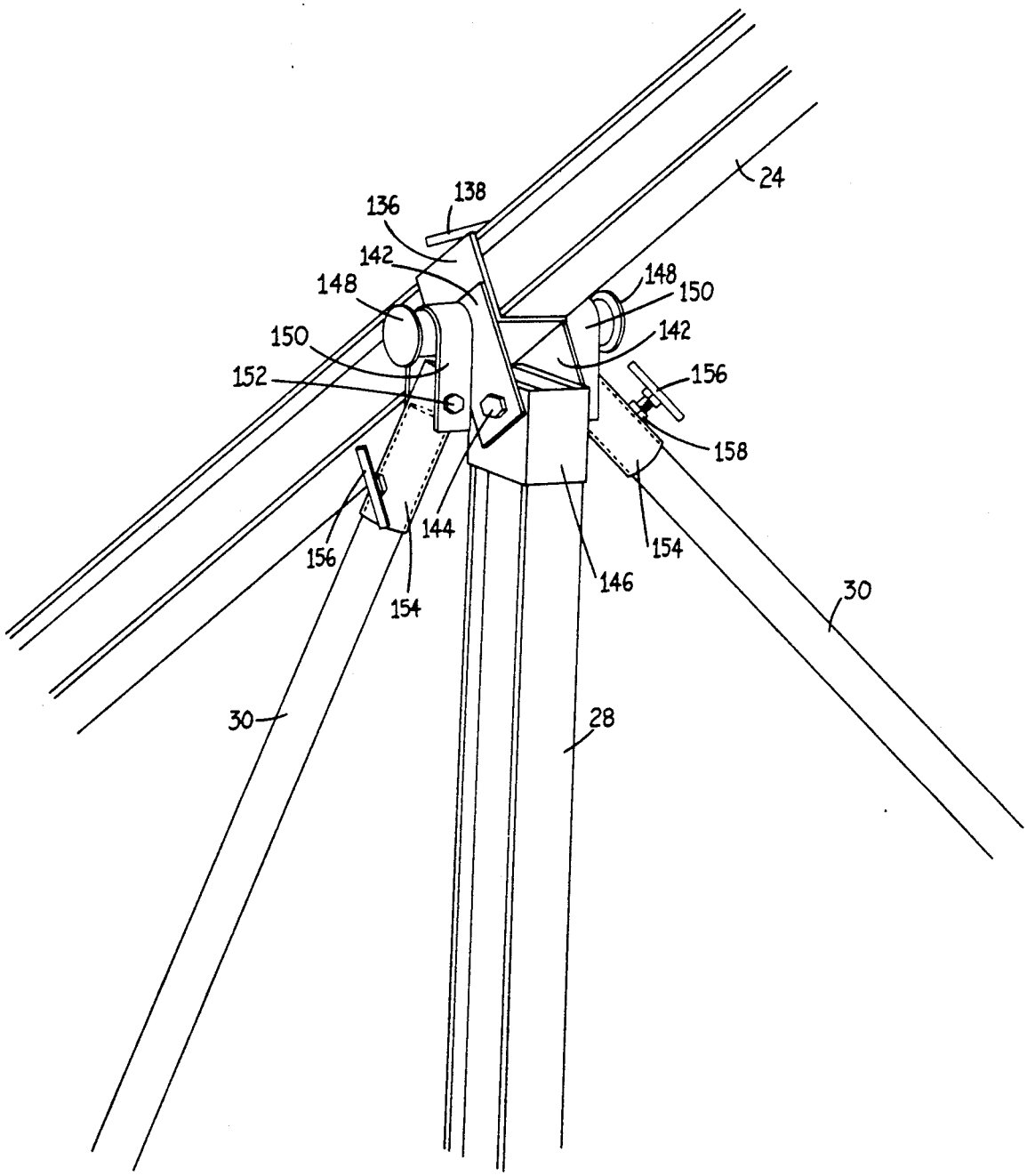
FIG. 17 is a front quarter perspective of the boom and leg adjustable joint.
Figures 18, 18A:
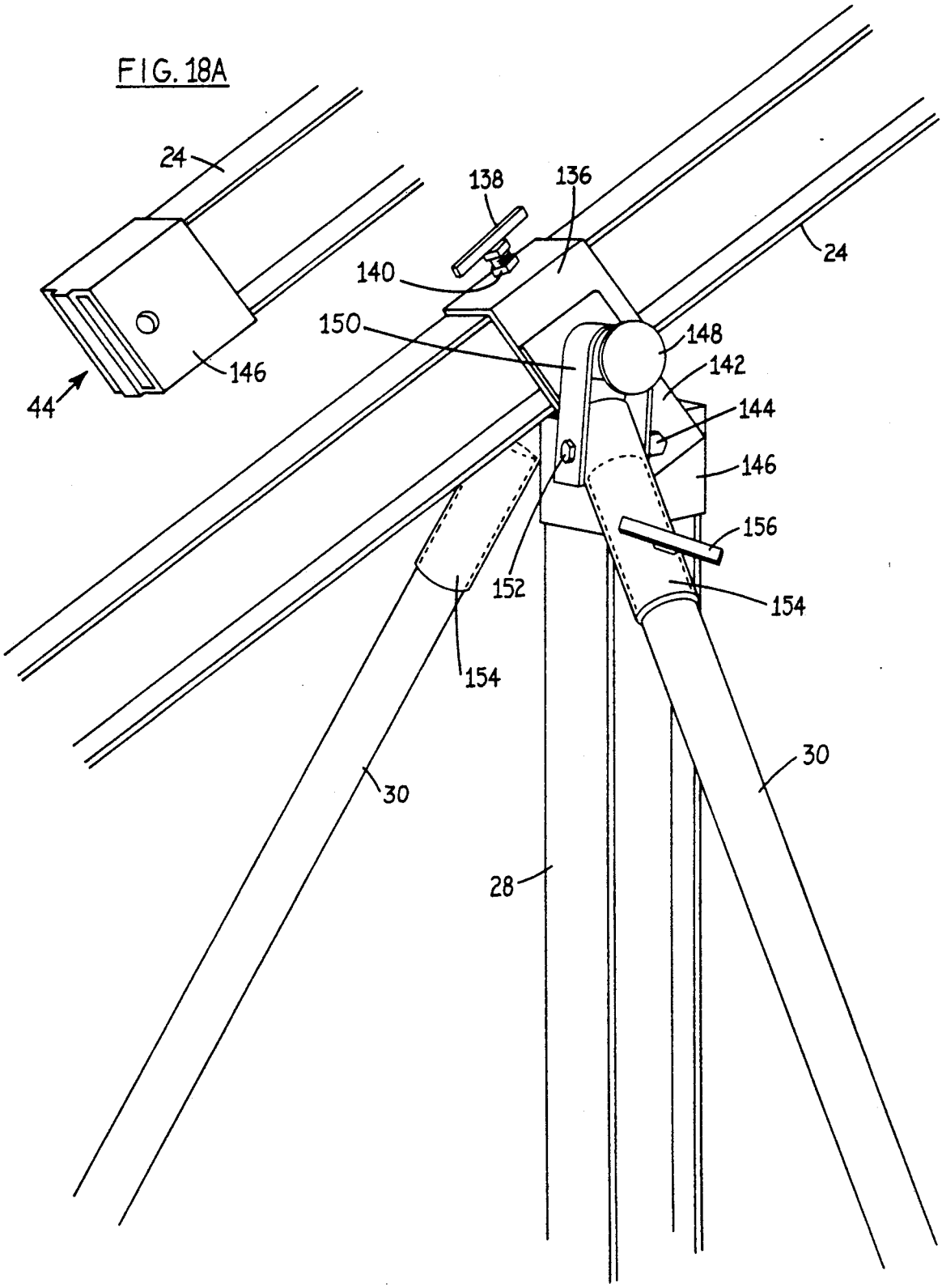
FIG. 18 is a rear quarter perspective of the boom and leg adjustable joint of FIG. 17.

FIGS. 17 and 18 illustrate the multiple adjustable attachment generally denoted by 50 wherein the central leg 28 and wind braces 30 are connected to the boom 24. A rectangular steel sleeve 136 engages the boom I-shape 24 with the boom slideable through the sleeve. To retain the boom 24 at a set position in the sleeve 136 a T-handle bolt 138 extends through a welded nut 140 and hole in the sleeve into contact with the boom 24. Attached to the sides of the sleeve 136 are a pair of steel plates 142. The steel 142 are perforated for a bolt connection 144 with a second sleeve or pocket 146. The second sleeve or pocket 146 is affixed to the upper end of the central leg 28 by the bolt 144. As illustrated in FIG. 18A the inward end 44 of the boom is also fitted with a sleeve or pocket 146 as is the lower end of the central support 28. The steel sleeve or pocket 146 reinforces the rotatably free mechanically fastened attachments because the boom and central support are I-section aluminum and additional load bearing support is required at the engagement of the fasteners.

On each side of the attachment 50 is a trunnion 148 welded to each plate 142 and extending outwardly. The trunnions 148 in turn are engaged by steel straps 150 which in turn are perforated to accept bolts 152. The bolts 152 engage steel cylindrical sleeves 154 in turn adjustably connected to the wind braces 30. Each sleeve 154 includes a T-handle bolt 156 and welded nut 158 for engagement with the wind braces 30. Thus, the wind braces 30 are rotatable about both the trunnions 148 and the bolts 152 and lengthwise adjustable in the sleeves 154. The central leg 28 is rotatable about the bolt 144. With this combination a wide variety of surface curvatures of water towers can be accommodated with the boom assemblies and the boom assemblies can easily be adjusted on site.

Figure 19:
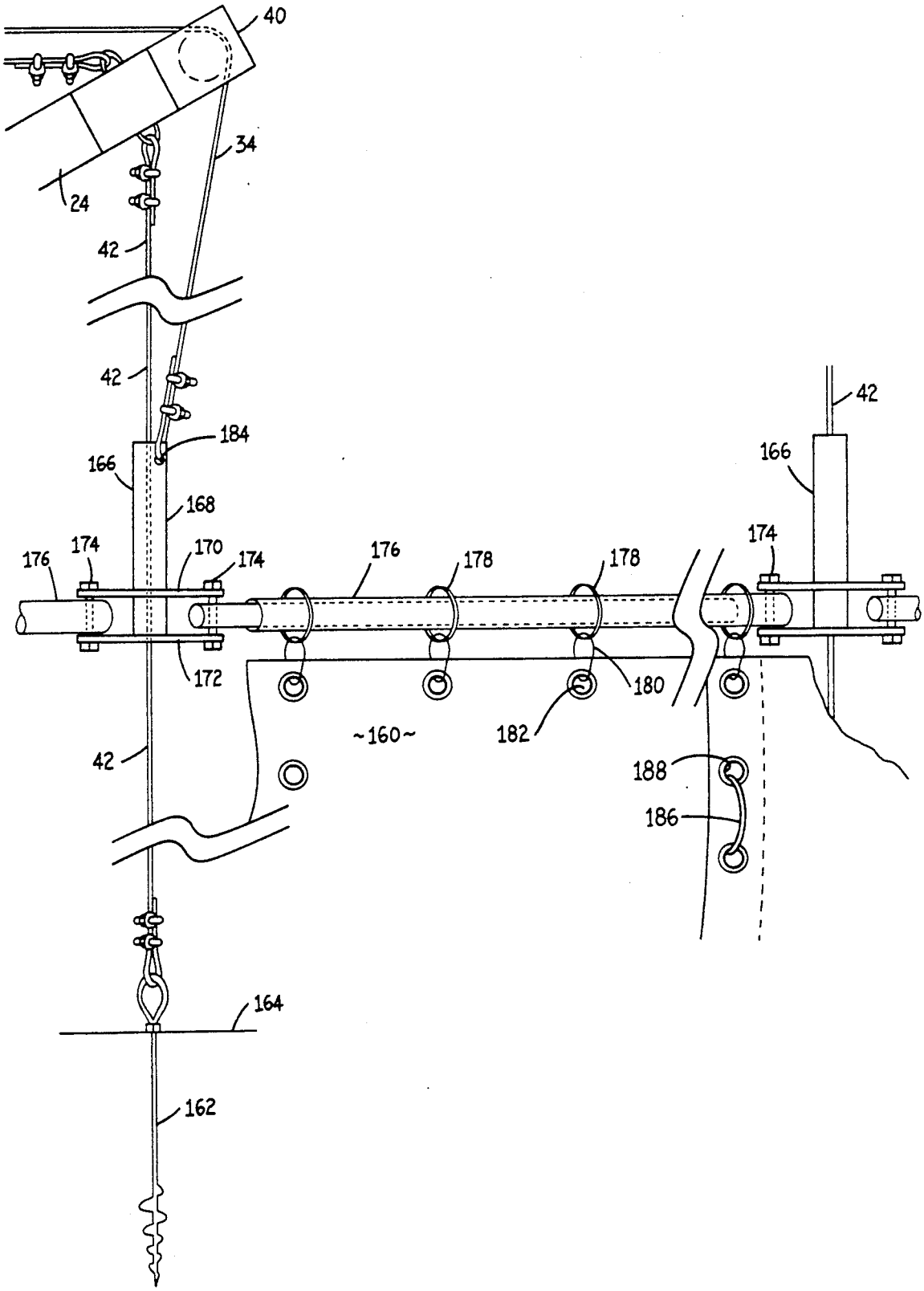
FIG. 19 is a broken away detail of the shroud panel assembly and connection to the hoisting cables.

Illustrated in FIG. 19 are details of the connection or shroud panels 160 to the hoisting cables 34 and a vertical guide cables 42. A screw anchor 162 is placed in the ground 164 to retain the lower end of each guide cable 42. One or more cable guides 166 are positioned on the guide cables 42. The cable guides comprise a steel tube 168 welded to a pair of parallel steel plates 170 and 172 to form an inverted "T" through which the guide cable 42 passes. The ends of the plates 170 and 172 are perforated to accept bolts 174 in turn connected to horizontal telescopeable rod and tube assemblies 176. The rod and tube assemblies extend between cable guides 166 on adjacent guide cables 42.

A plurality of rings 178 are placed on each rod and tube assembly 176 and latching hooks 180 connect the rings 178 to reinforced eyelets 182 in the upper edge of each panel 160. The hoisting cables 34, being attached to the cable guides 166 at 184, simultaneously raise the panels 160 with the panels evenly supported on the rod and tube assemblies 176. The adjacent vertical panels are fastened together 186 through the eyelets 188 along the adjacent vertical edges as shown in FIG. 19.

With the apparatus disclosed above, the individual panels can extend the full height of a water tower. The experimentally tested apparatus raises panels 180 feet long to reach from ground to just below the booms 24. Although full height panels have proven successful, shorter panels may be utilized by adding parallel cable guide, rod and tube assemblies about the structure between upper and lower panels. The added cable guides are also installed on the vertical guide cables 42 and connected to the hoisting cables 34 by supplemental vertical hoist cables joined to the cable guides thereabove.

Although the boom assemblies have been described in terms of their application to the compound curvature tops of water towers, it may be appreciated that the boom assemblies can be applied to flat roofs, roofs of multiple flat surfaces, and the flat or curved side walls of multi-story water towers and other structures. In the latter side wall applications the boom assembly is turned over and the pads for the stabilizers attached to the flat or curved sides well above the pad for the inboard end of the boom. Thus, the boom assemblies can be moved from structure to structure and merely readjusted for each structure as the roof or side walls require.

We claim:

1. Apparatus to temporarily enclose multi-story structures comprising a plurality of booms extending outwardly about at least a portion of the structure adjacent the top of the structure, said booms extending beyond the periphery of the structure, a sheave attached at the outboard end of each boom and a vertically extending hoisting cable supported by each sheave to form a plurality of downwardly extending hoisting cables, a plurality of flexible panels, means on the panels to attach the panels together to form a panel assembly and means to attach the panel assembly to the plurality of downwardly extending hoisting cables whereby upon raising the hoisting cables substantially simultaneously, the panel assembly forms an enclosure about at least a portion of the structure.

guide cables each attached to the outboard ends of the booms, said guide cables extending downwardly to anchorage means, said anchorage means located at the bottom of the enclosure, and guide means on said panel assemblies, said guide means in engagement with the plurality of guide cables.

2. The apparatus of claim 1 including a central support attached to each boom, the inward end of each boom and lower end of each central support being temporarily attachable to the structure.

3. The apparatus of claim 2 including at least one stabilizer attached to each boom, the lower end of each stabilizer being temporarily attachable to the structure.

4. The apparatus of claim 3 wherein the attachments of the boom, central support and stabilizer to the structure comprise pads temporarily weldable to the structure and rotatably free means to attach the pads to the boom inboard end and the central support and stabilizer lower ends.

5. The apparatus of claim 3 wherein the attachments of the boom, central support and stabilizer to the structure comprise brackets permanently attached to the structure and pads temporarily attachable to the brackets with mechanical fasteners, and rotatably free means to attach the pads to the boom inboard end and the central support and stabilizer lower ends.

6. The apparatus of claim 3 wherein the attachment of the central support to the boom includes translational adjustability of the boom relative to the central support.

7. The apparatus of claim 6 wherein the attachment of the stabilizer to the boom includes translational adjustability of the boom relative to the stabilizer.

8. The apparatus of claim 6 wherein the attachment of the central support to the boom and the attachment of the stabilizer to the boom both include rotational freedom relative to the boom.

9. The apparatus of claim 8 wherein the attachment of the stabilizer to the boom includes a trunnion.

10. The apparatus of claim 1 including a plate, a central hole in said plate and a plurality of sheaves attached to said plate, said sheaves so located on the plate as to guide hoisting cables over said sheaves and through said central hole.

11. The apparatus of claim 10 including means on said plate to attach tie back cables and a plurality of tie back cables extending from the booms to said plate.

12. The apparatus of claim 10 wherein said hoisting cables are jointed together below said central hole and wherein a single cable attached to said hoisting cables extends to a hoisting engine.

13. The apparatus of claim 10 wherein said plate includes means to attach the plate to the top of the structure.

14. The apparatus of claim 1 wherein said panel assemblies comprise horizontal members that extend between guide means on adjacent guide cables and a plurality of attachments on said horizontal members from which hang the individual flexible panels.

15. The apparatus of claim 14 wherein said horizontal members include telescoping means to adjust the member length between adjacent guides cables.

16. The apparatus of claim 14 wherein the means to attach the panel assemblies to the hoisting cables comprises the guide means.

17. The apparatus of claim 16 wherein the guide means comprise tubular sleeves engaging the guide cables.

18. The apparatus of claim 14 wherein adjacent panels are joined together by a plurality of fastening means along the vertical edges of the panels and individual panels extend the full height of the raised enclosure.

19. The apparatus of claim 1 wherein a short cable and block are suspended from the boom outboard end sheave and the hoisting cable extends downwardly from both sides of the block, one end of each hoisting cable extending to a hoisting engine.

* * * * *